United States Patent [19]

Niemeier et al.

[11] 4,418,675

[45] Dec. 6, 1983

[54] ADJUSTING DEVICE FOR A FUEL-INJECTION PUMP OF AN INTERNAL COMBUSTION ENGINE

[75] Inventors: Gerd Niemeier, Stuttgart; Ulrich Conrad, Ludwigsburg, both of Fed. Rep. of Germany

[73] Assignee: Daimler-Benz Aktiengesellschaft, Stuttgart, Fed. Rep. of Germany

[21] Appl. No.: 349,518

[22] Filed: Feb. 17, 1982

[30] Foreign Application Priority Data

Feb. 17, 1981 [DE] Fed. Rep. of Germany ..... 3105738

[51] Int. Cl.[3] ..... F02M 59/20

[52] U.S. Cl. ..... 123/501; 123/509

[58] Field of Search ..... 123/501, 509, 502, 343

[56] References Cited

U.S. PATENT DOCUMENTS 2,829,630 4/1958 Ziesche et al. ..... 123/501
4,337,747 7/1982 Jefferson et al. ..... 123/501

FOREIGN PATENT DOCUMENTS 254375 8/1911 Fed. Rep. of Germany ..... 123/501
1283596 11/1968 Fed. Rep. of Germany ..... 123/501
1142324 3/1956 France ..... 123/501
29938 8/1919 Norway ..... 123/501
456805 11/1936 United Kingdom ..... 123/501

*Primary Examiner*—Ira S. Lazarus
*Assistant Examiner*—Magdalen Moy
*Attorney, Agent, or Firm*—Craig & Burns

[57] ABSTRACT

In compact vehicle diesel engines, injection pumps are accessible only with difficulty for the purpose of adjusting a starting time of fuel delivery. An adjusting device is provided which includes an adjusting bolt or screw which may easily be reached from a top side of the engine. The adjusting bolt or screw includes a collar which is adapted to engage in a corresponding annular slot provided in an installation flange of a housing of the fuel-injection pump. A threaded portion of the adjusting bolt or screw is threadably accommodated in a threaded member pivotably fastened to the engine. When the adjusting bolt or screw is turned, the injection pump may be rotatably adjusted while a camshaft of the fuel-injection pump, connected to a timing drive of an internal combustion engine, remains in a previous position, thereby varying the start time of fuel delivery of the fuel-injection pump.

6 Claims, 2 Drawing Figures

ADJUSTING DEVICE FOR A FUEL-INJECTION PUMP OF AN INTERNAL COMBUSTION ENGINE

Figure 1:
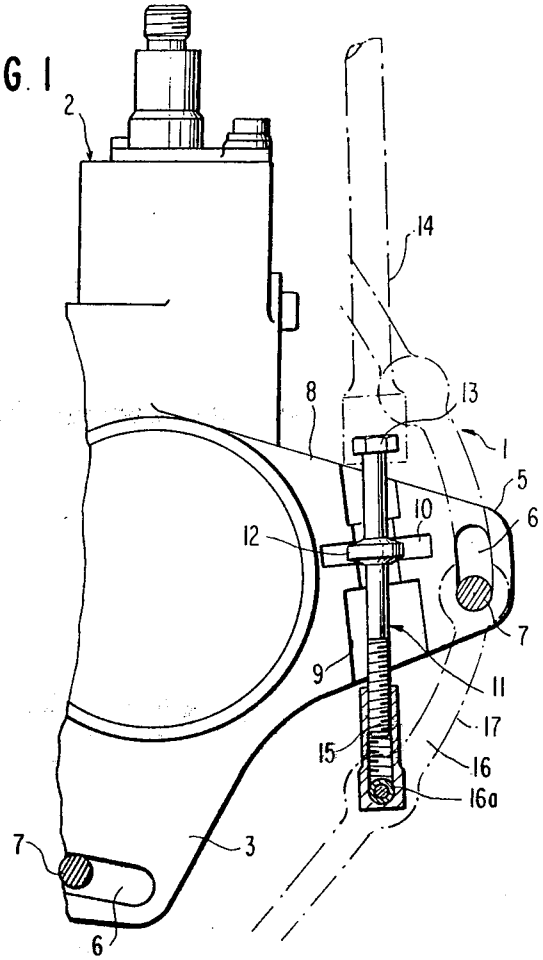

The present invention relates to an adjusting device and, more particularly, to a device for adjusting a starting time of a fuel delivery of a fuel-injection pump, having a preset starting time of fuel delivery, secured to an internal combustion engine by an installation flange of a housing of the fuel-injection pump, with the adjusting device being adapted to enable an adjustment of the injection pump in a direction of rotation thereof with an appropriate positioning of the crankshaft of the engine.

With fuel-injected internal combustion engines, it is possible to change or alter a position of the fuel-injection pump by rotating the housing of the pump, whereby the pump pistons are rotated about a fixed camshaft of the fuel-injection pump which has a specific fixed relationship with respect to a crankshaft of an internal combustion engine through a timing drive means. By adjusting the fuel-injection pump, a start time of a fuel delivery or a pressure increase may be changed with respect to a position of only one pump piston in a cylinder.

A disadvantage of previously proposed fuel-injection pump constructions resides in the fact that it is only possible to change or alter a position of the fuel-injection pump for the purposes of an adjustment by loosening the screws securing the fastening flange to the engine by manual force and/or by auxiliary means such as, for example, crowbars, hammers, or the like which are intrinsically undesirable since the components of the injection pump and/or housing of the fuel-injection pump may readily be damaged.

Although fuel-injection pumps are mounted on an engine with a preset starting time for fuel delivery, because of many tolerances which often accumulate unfavorably prior to a first starting-up of the engine and also after a relatively long running period as a result of wear due to, for example, an elongation of the timing chain of the timing means of an engine, it is necessary to correct the start time of fuel delivery. However, in motor vehicle constructions with compact internal combustion engines, it is extremely difficult to effect an adjustment of the fuel-injection pump, since the pump is not longer readily accessible for the purposes of such an adjustment.

The aim underlying the present invention essentially resides in providing a simple adjusting device for a fuel-injection pump of an internal combustion engine which enables an altering or changing of a position of the fuel-injection pump for the purposes of an adjustment from the top side of the internal combustion engine without requiring the use of special tools.

In accordance with advantageous features of the present invention, an adjusting means in the form of a bolt or screw is rotatably nonaxially displaceably guided in an opening provided in an installation of the fuel-injection pump, with the bolt or screw being insertable into a threaded mounting member secured to the internal combustion engine. By a turning of the adjusting bolt or screw, the fuel-injection pump may readily be adjusted.

Advantageously, the adjusting bolt or screw is arranged so as to be readily accessible from the top side of the engine, with the adjusting bolt or screw being adjusted by bolt or screw operating tools such as, for example, socket wrenches or the like, thereby enabling a quick and accurate definite change in the position of the fuel-injection pump.

In accordance with still further features of the present invention, the adjusting bolt or screw is provided with a collar adapted to be accommodated in an annular slot of the opening or recess provided in the installation flange to thereby secure the adjusting bolt or screw in the installation flange against axial displacement. The collor may, for example, be provided with crowned faces thereon.

Preferably, in accordance with the present invention, the adjusting bolt or screw is secured in position by a housing part of the internal combustion engine, with the housing part covering the opening or recess in the installation flange accommodating the adjusting bolt or screw when the injection pump is flanged or secured to the housing part, thereby dispensing with the need for additional mounting parts on the installation flange for the adjusting bolt or screw.

In accordance with still further features of the present invention, the threaded mounting member is constructed as an end-socket pivotably secured to a housing part of the internal combustion engine such as, for example, a housing part of the timing drive means of the engine.

Accordingly, it is an object of the present invention to provide an adjusting device for a fuel-injection pump which avoids, by simple means, the shortcomings and disadvantages encountered in the prior art.

Another object of the present invention resides in providing an adjusting device for a fuel-injection pump which enables an adjustment of the fuel-injection pump so as to alter or adjust a starting time of fuel delivery of the injection pump in a relatively simple, quick, and accurate manner.

Yet another object of the present invention resides in providing an adjusting device for a fuel-injection which is readily accessible from a top side of an internal combustion engine on which the fuel-injection pump is mounted.

A further object of the present invention resides in providing an ajusting device for a fuel-injection pump which enables an adjustment of the fuel-injection pump without requiring any special tools.

A still further object of the present invention resides in providing an adjusting device for a fuel-injection pump which is simple in construction and therefore relatively inexpensive to manufacture.

Figure 2:
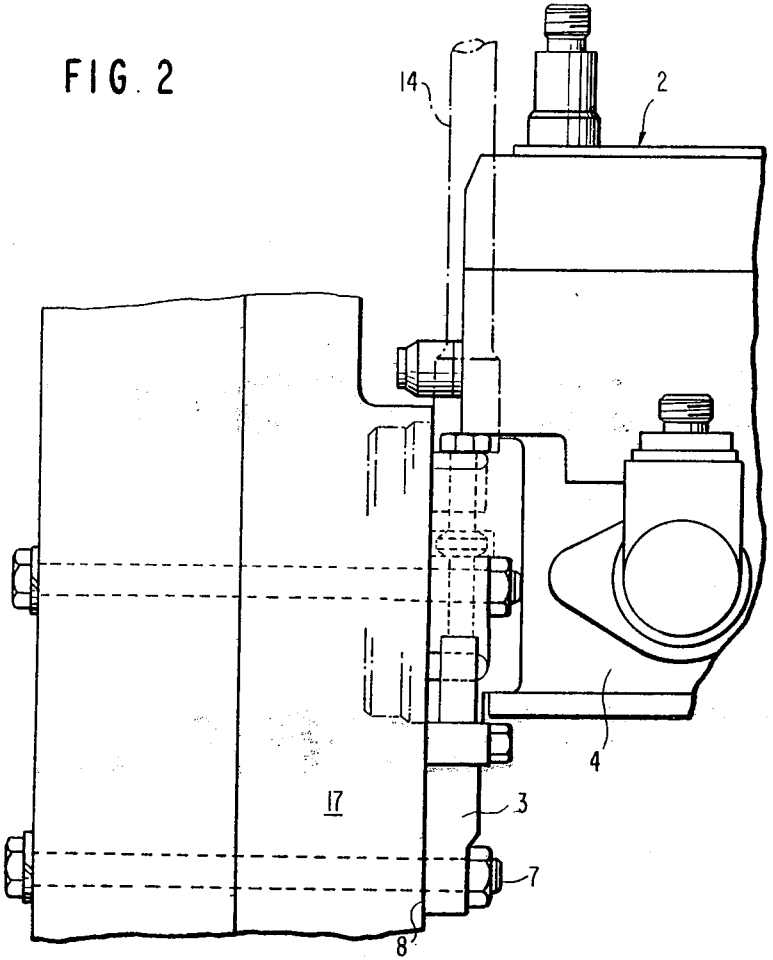

These and other objects, features, and advantages of the present invention will become more apparent from the following description when taken in connection with the accompanying drawing which shows, for the purposes of illustration only, one embodiment in accordance with the present invention, and wherein:

FIG. 1 is a partial end view of a fuel-injection pump with an installation flange accommodating the adjusting device of the present invention; and FIG. 2 is a partial side view of the fuel-injection pump, together with the adjusting device of the present invention, flanged to a housing part of the internal combustion engine.

Referring now to the drawing wherein like reference numerals are used in both views to designate like parts and, more particularly, to FIG. 1, according to this figure, an adjusting device generally designated by the reference numeral 1, for enabling an adjusting of a starting time of a fuel delivery of a fuel-injection pump generally designated by reference numeral 2 for an air-compressing engine, is arranged in a continuous opening or recess 9 provided in an installation flange 3 of a housing 4 of the fuel-injection pump 2.

The installation flange 3 includes three radially extending circumferentially spaced arms 5, only two of which are shown in the drawing, with each of the arms 5 being provided with an elongated slot or hole 6 for accommodating flange-fastening bolts or screws 7. The continuous opening or recess 9 is arranged in a bearing face 8 of one of the arms 5, with the continuous opening or recess 9 being of a downwardly extending, multistepped construction and having an annular slot 10 disposed approximately in a longitudinal center thereof.

An adjusting bolt or screw generally designated by the reference numeral 11 is rotatably accommodated in the opening or recess 9, with a collar 12, which may be provided with crowned faces, being arranged on the adjusting bolt or screw 11. The collar 12 is adapted to be accommodated in the annular slot 10 so as to secure the adjusting bolt or screw 11 against movement in an axial direction.

The adjusting bolt or screw 11 is provided at an upper end thereof with a tool-gripping means such as, for example, a hexagon head 13 so as to enable the adjusting bolt or screw 11 to be turned by, for example, a socket wrench 14 or the like. A lower end of the adjusting bolt or screw 11 is provided with a threaded portion 15 which projects outwardly from the installation flange 3. The threaded portion 15 of the adjusting bolt or screw 11 is threadably securable to a threaded member 16 constructed, for example, as a threaded end socket. The threaded member 16 is pivotably fastened by a suitable pivot means **16*a* to a housing part 17** which may, for example, be a portion of a housing of a timing drive means of the internal combustion engine.

As shown most clearly in FIG. 2, when the injection pump 2 is mounted to the housing part 17 of the timing means, the housing part 17 functions as a cover for the opening or recess 9 accommodating the adjusting bolt or screw 11, thereby securing the adjusting bolt or screw 11 in position.

When the fuel-injection pump 2 is initially mounted to the housing part 17 of the timing drive means, the fuel-injection pump 2 is arranged in such a manner that a camshaft of the fuel-injection pump 2 and the crankshaft of the internal combustion engine assume a specific angular relationship with respect to one another, thereby initially setting the start time of fuel delivery of the fuel-injection pump 2.

Should an adjustment of the fuel-injection pump 2 become necessary due to, for example, manufacturing tolerances, wear of the components, etc., the adjustment may quickly and accurately be carried out by loosening the flangefastening screws 7 and turning the adjusting bolt or screw 11 into or out of the threaded member 16, thereby rotating the fuel-injection pump 2 in such a manner so as to vary the starting time of fuel delivery of the fuel-injection pump 2.

As apparatus from FIGS. 1 and 2, the adjusting bolt or screw 11 may be reached from a top side of the engine by means of the socket wrench 14. Since the adjusting bolt or screw 11 assumes a definite position, it is also possible to carry out an adjustment by means of automatic tools such as, for example, adjusting robots, thereby enabling an adjusting of a starting time of the fuel delivery during engine assembly or during the production test run with the internal combustion engine being operated at an idling speed using a suitable measuring device. Moreover, since the adjusting device 1 remains on the engine, it can readily be employed for carrying out adjusting of the fuel-injection pump 2 in after-sales service work.

While we have shown and described only one embodiment in accordance with the present invention, it is understood that the same is not limited thereto but is susceptible of numerous changes and modifications as known to one having ordinary skill in the art, and we therefore do not wish to be limited to the details shown and described herein but intend to cover all such changes and modifications as are encompassed by the scope of the appended claims.

We claim:

1. A device for adjusting a start time of fuel delivery of a fuel-injection pump, comprising a fuel-injection pump including a flange means for enabling a mounting of the fuel-injection pump on an internal combustion engine, the adjusting device includes an adjusting member, guide means being provided in the flange means for rotatably and nonaxially displaceably receiving the adjusting member, mounting means adapted to be secured on the engine for adjustably accommodating the adjusting member so as to enable an adjustment of the fuel-injection pump upon an adjustment of the adjusting member with respect to the mounting means, the guide means including a recess formed in the flange means, and an annular slot formed in the recess, and the adjusting member including a collar means adapted to be disposed in the annular slot so as to prevent an axial displacement of the adjusting member.

2. The adjusting device according to claim 1, wherein the collar means includes a plurality of crowned faces.

3. The adjusting device according to claim 1, wherein means are provided for securing the adjusting member in the recess when the fuel-injection pump is mounted to the engine.

4. The adjusting device according to claim 3, wherein the means for securing includes a portion of a housing of the engine adapted to cover the recess when the injection pump is mounted to the engine.

5. The adjusting device according to claim 4, wherein the threaded member is constructed as a threaded end socket pivotably mounted to the portion of the housing of the engine adapted to cover the recess.

6. The adjusting device according to claim 5, wherein the portion of the housing is a portion of a housing for a timing drive means of the engine.

* * * * *